United States Patent [19]

Gelinas

[11] 4,369,705

[45] Jan. 25, 1983

[54] PRINTING PRESS

[75] Inventor: Wilfred R. Gelinas, Jewett City, Conn.

[73] Assignee: Harris Corporation, Melbourne, Fla.

[21] Appl. No.: 190,344

[22] Filed: Sep. 24, 1980

[51] Int. Cl.[3] ..... B41F 7/10; B41F 7/12

[52] U.S. Cl. ..... 101/177; 101/180; 101/182; 101/218; 101/247

[58] Field of Search ..... 107/177, 180, 176, 178, 107/179, 181, 182, 220, 221, 222, 223, 224, 225, 137, 138, 139, 140, 143, 247, 144; 92/13.3, 13.4, 62, 63, 66, 151, 152, 150

[56] References Cited

U.S. PATENT DOCUMENTS

| | | | |
|---|---|---|---|
| 2,969,042 | 1/1961 | Litz et al. | 92/13.3 X |
| 3,329,086 | 7/1967 | Pullen | 101/179 X |
| 3,452,672 | 7/1969 | Bolza-Schunemann et al. | 101/177 |
| 3,769,910 | 11/1973 | Heimlicher et al. | 101/177 |
| 3,986,454 | 10/1976 | Granger | 101/216 |
| 4,218,972 | 8/1980 | Fujishito | 101/180 X |

FOREIGN PATENT DOCUMENTS

| | | | |
|---|---|---|---|
| 137829 | 9/1979 | Fed. Rep. of Germany | 101/177 |
| 1257552 | 2/1961 | France . | |
| 2392817 | 12/1978 | France . | |

*Primary Examiner*—J. Reed Fisher
*Attorney, Agent, or Firm*—Yount & Tarolli

[57] ABSTRACT

The disclosure relates to a printing press which is capable of operating either as a perfecting printing press or as a multicolor press. The press includes a common impression cylinder which is fixed in the frame of the printing press. A pair of blanket cylinders are mounted in eccentrics and are movable along arcuate paths between two printing positions. In one printing position the blanket cylinders are effective to print on opposite sides of a web passed between them, and in the other printing position both blanket cylinders will print on the same side of a web when the web is passed between the blanket cylinders and the common impression cylinder. The disclosure includes a unique linkage mechanism for shifting the blanket cylinder to four distinct positions, the two previously mentioned printing positions, and two throw off positions, one associated with each of the printing positions. The plate cylinders associated with each of the two mentioned blanket cylinders are also mounted in eccentrics, and a form following mechanism is used to maintain the flat between form rollers and plate cylinders when the plate cylinders are moved. The printing press also includes an upper deck having a blanket and plate cylinder located above the common impression cylinder.

11 Claims, 10 Drawing Figures

PRINTING PRESS

BACKGROUND OF THE INVENTION

The present invention relates to printing presses having shiftable cylinders and to a mechanism for shifting the positions of printing cylinders within a printing press.

There are known printing presses in which the position of a blanket cylinder may be changed to provide different modes of printing. Typically, these presses include an impression cylinder, a pair of blanket cylinders, and a pair of plate cylinders. The blanket cylinders are mounted so that they can be shifted between two positions. In a first position the blanket cylinders simultaneously print on opposite sides of a web passed between them. This mode is known as a perfecting mode. In a second position the blanket cylinders each cooperate with the same impression cylinder. When the press is set up in this mode, it will print two impressions, usually in different colors, on one side of a web. The plate cylinders are moved to effect a change in the printing mode.

Frequent jams of the web have been a problem with known web presses having a pair of shiftable blanket cylinders and a common impression cylinder. When such a press is in the perfecting mode, the rotating impression cylinder can catch the web, and once a jam has started, the impression cylinder forces the web backwards against the direction of rotation of a blanket cylinder. This makes a bad situation worse because the cusp between the blanket cylinders gets stuffed with web which is not easily removed.

This problem can be solved by increasing the distance between the blanket cylinders and the impression cylinder when the blanket cylinders are in the blanket-to-blanket perfecting mode. In the past this has been done by mounting the impression cylinder so that it can be moved upward away from the cusp defined by the blanket cylinders when the blanket cylinders are in the blanket to blanket, perfecting mode. This has been effective in eliminating the jamming problem, but other disadvantages have resulted.

It has been suggested to provide a press of the type discussed above with an additional printing couple having a blanket cylinder which bears against the common impression cylinder. In such a press it would be possible to print three colors on a single side of a web, or to print two colors on one side and one color on the other side of a web, or to print on two entirely different webs simultaneously. When such a press is equipped with an impression cylinder which is movable to reduce jamming, the third or upper deck blanket cylinder must be set to one side or the other of a vertical plane through the impression cylinder so that the upper deck blanket cylinder does not obstruct the path of movement of the impression cylinder. This requirement has given rise to presses having so-called left-handed or right-handed upper decks depending on which side of the vertical centerline of the press the upper deck blanket cylinder is located. Whether a particular user had a press built for him with a left-handed or right-handed upper deck depended on what web lead he was likely to want most often. With a left-handed upper deck some web leads are possible which are not possible with a right handed upper deck, and vice versa.

The selection of web leads is limited in part by the necessity of having an impression cylinder scrubber.

The impression cylinder scrubber deposits a thin film of water on the impression cylinder to prevent the build-up of ink on its surface. When a left or right-handed upper deck is used, there is not room for a scrubber between the upper deck blanket cylinder and the closest lower deck blanket cylinder. The impression cylinder scrubber must be positioned on the side of the vertical plane through the impression cylinder opposite from the upper deck blanket cylinder. Because of this requirement, the impression cylinder scrubber further restricts the number and flexibility of web leads.

In addition to problems with jams and the upper deck blanket cylinder discussed above, known printing presses which have two modes of printing are not easily shifted between modes. The mechanisms utilized to shift the cylinder positions in printing presses having two printing modes vary. For example, U.S. Pat. Nos. 3,986,454 and 3,769,910 disclose offset web presses in which each blanket cylinder is pivotable about an axis coincident with the axis of the cooperating plate cylinders. Another cylinder shifting mechanism is shown in French Pat. No. 1,257,552. In this press each blanket cylinder is mounted in double eccentrics from each of which a lever extends. The levers in turn are connected by links and are moved simultaneously to shift each cylinder's position.

Other cylinder shifting mechanisms are shown in U.S. Pat. Nos. 3,452,672 and 3,329,086. In the presses disclosed in these patents cylinders are mounted in eccentric bushings and various links and levers connect hydraulic or pneumatic cylinders to the bushings and cause them to rotate to shift the cylinders' positions.

Presses of the type discussed also have throw-off mechanism to disengage the cylinders from each other for make ready. The throw-off mechanisms have generally been part of the cylinder shifting mechanism. In U.S. Pat. Nos. 3,452,672 and 3,329,086 the eccentrics which enable mode changing also are utilized for throwing off the cylinders. In both cases a linkage which shifts the cylinders' positions must be manually shifted or adjusted before modes of printing can be changed. In U.S. Pat. No. 3,452,672 a pneumatic or hydraulic cylinder is actuated to achieve throw-off; changing of printing modes is achieved by manually removing a pin, turning a gear and then reinserting the pin. In U.S. Pat. No. 3,329,086 a link (unnumbered and shown in the lower right of FIG. 2*a*) is connected by a pin to a linkage which controls throw-off and mode shifting. To shift modes the connecting pin is shifted from its upper position to its lower position by manually turning a threaded rod. From this review of the prior art it is clear that in the known presses which are capable of two modes of printing, shifting between modes has required manual manipulation of a control linkage.

SUMMARY OF THE INVENTION

The present invention is a printing press which has two printing modes, a perfecting mode and a multicolor mode. The printing press of the present invention is a web fed offset press which has a single impression cylinder and three printing couples, each with a blanket cylinder, a plate cylinder and the necessary inkers and dampers. The press is arranged in an upper deck with one printing couple and a lower deck with two printing couples.

According to the present invention the lower deck plate cylinders and blanket cylinders are all mounted in eccentrics while the impression cylinder is fixed. This permits the lower deck blanket and plate cylinders to be shifted between (1) a perfecting mode of printing in which the blanket cylinders print on opposite sides of a web pressed between them and (2) a multicolor mode in which the blanket cylinders both print on the same side of a web passed between the blanket cylinders and the impression cylinder. Mounting both the lower deck blanket cylinders and the lower deck plate cylinders so that they are movable improves on prior known presses by creating a larger distance between the fixed impression cylinder and the two, shiftable blanket cylinders when the press is in its blanket-to-blanket perfecting mode, and thereby reduces jamming.

Additional advantages also arise from this structure. First, the impression cylinder is mounted for rotation about a fixed axis. This eliminates any need for an impression cylinder shifting mechanism. Also in a press constructed according to the present invention it is not necessary to offset the upper deck blanket cylinder to the left or right of the vertical center line of the press. Instead the upper deck blanket cylinder may be mounted directly above and in vertical alignment with the impression cylinder, and a movable scrubber may be placed on either side of the impression cylinder. This eliminates the need for making different presses depending on the web lead a user is going to use, since web leads to either side of the impression cylinder are possible.

In a press constructed in accordance with the present invention the impression cylinder is fixed, and both the lower deck plate and blanket cylinders are mounted in eccentrics. The blanket eccentrics are actuated by a mechanism which forms another important aspect of the present invention. The shifting mechanism of the blanket cylinders provides both a throw off mechanism and means for shifting these cylinders between the two printing modes without requiring manual manipulation.

The shifting mechanism moves the press cylinders between the multicolor printing position and the perfecting printing position a sufficiently large distance to accommodate the gears used to drive the plate, blanket and impression cylinders. The movement of the blanket cylinders between the perfecting printing position and the associated throw off position creates a space between the blanket and plate cylinders large enough to permit make ready operations to be performed, but still the drive gears connected with the plate and blanket cylinders remain at least partially in mesh with each other. This permits the entire press to be jogged during make ready or for maintenance such as cleaning the cylinders.

When in the throw off position from the perfecting printing mode, there is no contact between the gears connected with the blanket cylinders and the gear connected with the impression cylinder. However, when the shifting mechanism is activated to shift the press into the throw off position associated with the multicolor printing mode, the gears connected with the blanket cylinders move with the blanket cylinders and are pulled out of engagement with each other and both simultaneously move into mesh with the gear connected with the impression cylinder. When in this throw off position, it is possible to perform make ready operations on the press for multicolor printing. In this way the shifting mechanism moves the cylinders between the perfecting printing mode and the multicolor mode, provides a separate throw off position for each mode, and also accomplishes automatic shifting of the gears used to drive the cylinders in each of the modes and associated throw off positions.

In a press utilizing the present invention the blanket cylinders are mounted in eccentric bushings. The eccentrics enable the blanket cylinders to be shifted between a perfecting position in which they print on opposite sides of a web and a multi-color position in which they cooperate with the impression cylinder to print on the same side of a web. The eccentric bushings are connected by arms to a common link which assures simultaneous movement of the two blanket cylinders. The common link is caused to rotate by a double air cylinder connected to it through a linkage mechanism.

The double air cylinder comprises two pneumatic cylinders of different maximum lengths connected to each other in tandem with their piston rods extending coaxially but in opposite directions. By separately extending or retracting each of the piston rods, four different positions of the common link can be achieved, in one of which the blanket cylinders are in a blanket-to-blanket printing mode, in one of which the blanket cylinders are in a blanket-to-impression printing mode, and in two of which the blanket cylinders are in throw off positions, one for each of the two printing modes.

A press constructed according to the present invention also includes a cam and follower mechanism which enables the form rollers of the inkers and dampers in the lower deck printing units to follow the movement of the plate cylinder when it is shifted without the necessity of readjusting them. The flat formed between the form rollers and a respective plate cylinder is adjusted by means of a cam ring which is mounted for rotation about the axis of rotation of the plate cylinder. The form rollers are mounted on a bracket which is pivotably mounted to the press frame. The bracket is biased into engagement with the cam ring, and the cam ring is rotatable to vary the form flat.

Motion of the cam ring is controlled by a link which extends between the cam ring and the press frame. The link is threaded at one end and is received in a pivotable nut connected with the cam ring. The other end of the link is fixed to the press frame so that it is freely rotatable but fixed against axial motion. the link can be turned to regulate the angular position of the cam ring with respect to the plate cylinder thereby to adjust the flat. When the plate cylinder is shifted by rotating the eccentrics which mount it from one position to another, the link holds the cam ring so that it is forced to rotate in the opposite direction. The follower on the form roller bracket shifts position along the cam surface which is shaped to compensate for the change in position of the plate cylinder. In this way the form flats are preserved in adjustment when the mode of printing is changed.

BRIEF DESCRIPTION OF THE DRAWINGS

These and other features and advantages of the present invention will become apparent to those skilled in the art to which it pertains upon reading the following specification together with the accompanying drawings in which.

DESCRIPTION OF ONE PREFERRED EMBODIMENT

Figure 1:
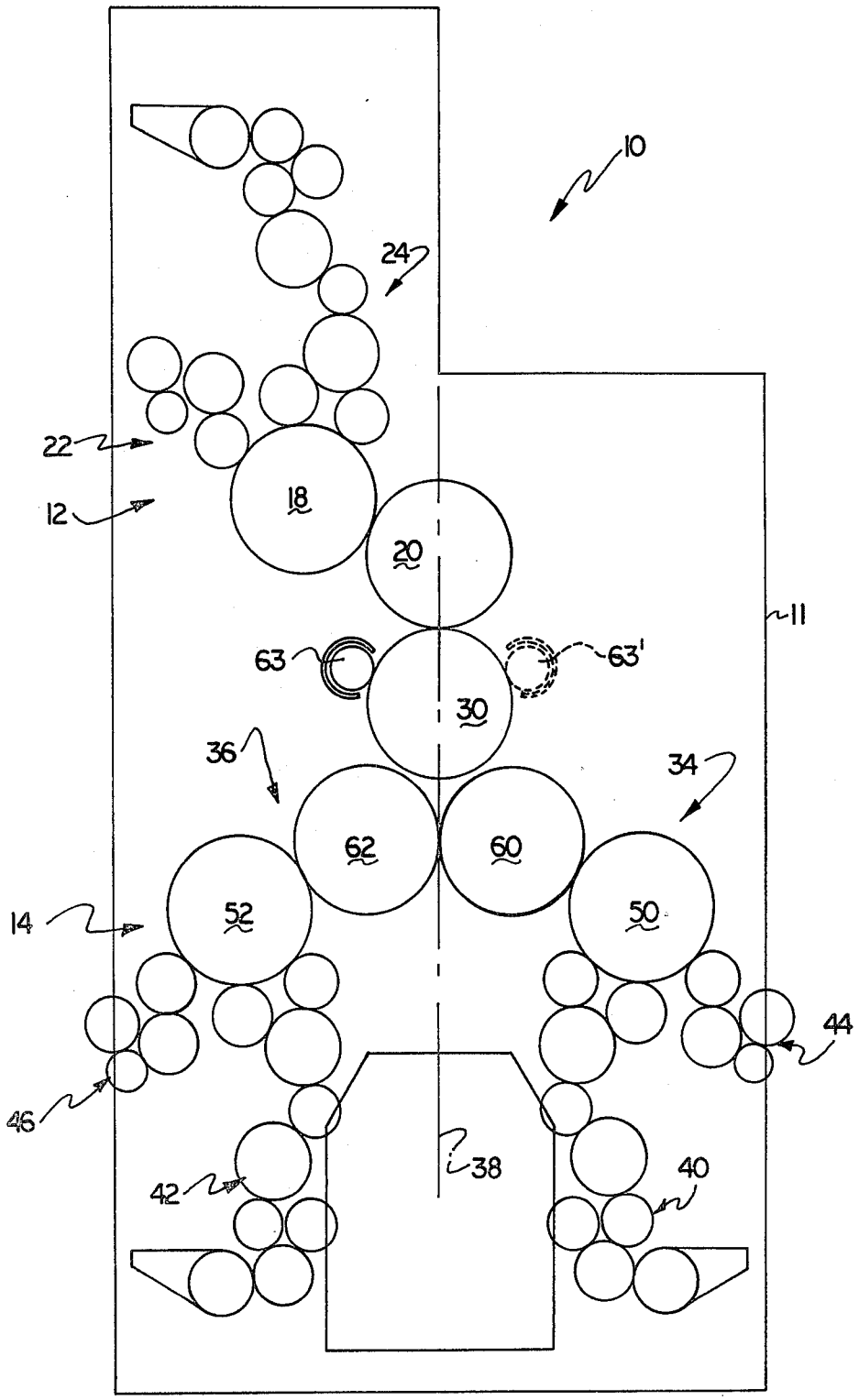
FIG. 1 is a schematic illustration of a printing press constructed according to the present invention.

FIG. 1 illustrates a web fed, offset press 10 having a frame 11 in which is mounted an upper deck 12 and a lower deck 14. The upper deck 12 has a single printing couple which includes a plate cylinder 18, a blanket cylinder 20, and an associated damper 22 and inker 24. The blanket cylinder 20 is mounted for cooperation with an impression cylinder 30 and transfers an inked impression to a web (not shown) passed between the blanket cylinder 20 and impression cylinder 30 in a well known manner.

The lower deck 14 includes two printing couples 34 and 36 which are symmetrical about a vertical center line 38 of the press 10. For this reason, from time to time, the lower deck printing units 34 and 36, and the components thereof, will be referred to as being on the righthand or lefthand side of the press 10, but it will be understood that this is merely for the purpose of convenience in describing the operation of the press 10, and is not intended to be limiting in any way. For example the press 10 could be turned on its side so that the center line 38 would be horizontal, or at some other angle.

The lower deck printing units 34 and 36 include the inkers 40 and 42, respectively, and dampers 44 and 46, respectively. The inkers 40 and 42 and dampers 44 and 46 apply moisture and ink to the plate cylinders 50 and 52 which in turn cooperate with blanket cylinders 60 and 62, respectively, and transfer inked impressions to the blanket cylinders in a conventional manner.

An impression cylinder scrubber 63 contacts the impression cylinder 30, coating with a thin spray of water to prevent unwanted ink build up. The scrubber is removable and may be positioned on the left side of the impression cylinder 30 as shown in solid, or it may be located on the right, as shown in phantom. Which position is selected depends on the particular web lead being used.

The plate cylinders 50 and 52 and blanket cylinders 60 and 62 are shiftable to achieve two different printing modes. The impression cylinder 30 is fixed in the frame and is not shiftable. FIGS. 2–5 illustrate schematically the impression cylinder 30, the plate cylinders 50 and 52 and the blanket cylinders 60 and 62 in each of four different positions. The position of the cylinders in FIG. 2 corresponds with that in FIG. 1, and shows the two blanket cylinders 60 and 62 touching the plate cylinders 50 and 52 and touching each other. This position is known as the blanket-to-blanket or perfecting mode because the blanket cylinders 60 and 62 will print inked impressions on opposite sides of a web 68 passed between them. When the cylinders 50, 52, 60 and 62 are set up in the perfecting mode, they are free of contact with the impression cylinder 30 which may, if desired, be operated independently in association with the upper deck blanket cylinder 20 (FIG. 1).

Those skilled in the art will understand that the blanket cylinders 60 and 62 do not ever touch the impression cylinder 30 when the press is in the multicolor, blanket-to-impression printing mode because when actually printing there would be a web of paper between the impression cylinder 30 and the blanket cylinders 60 and 62. Likewise, when the cylinders 60 and 62 are in the perfecting, blanket-to-blanket mode the cylinders do not actually touch each other because of the web passed between them. The word "touch" is thus used loosely and when used to describe the position of cylinders is not meant to be taken literally.

Figure 3:
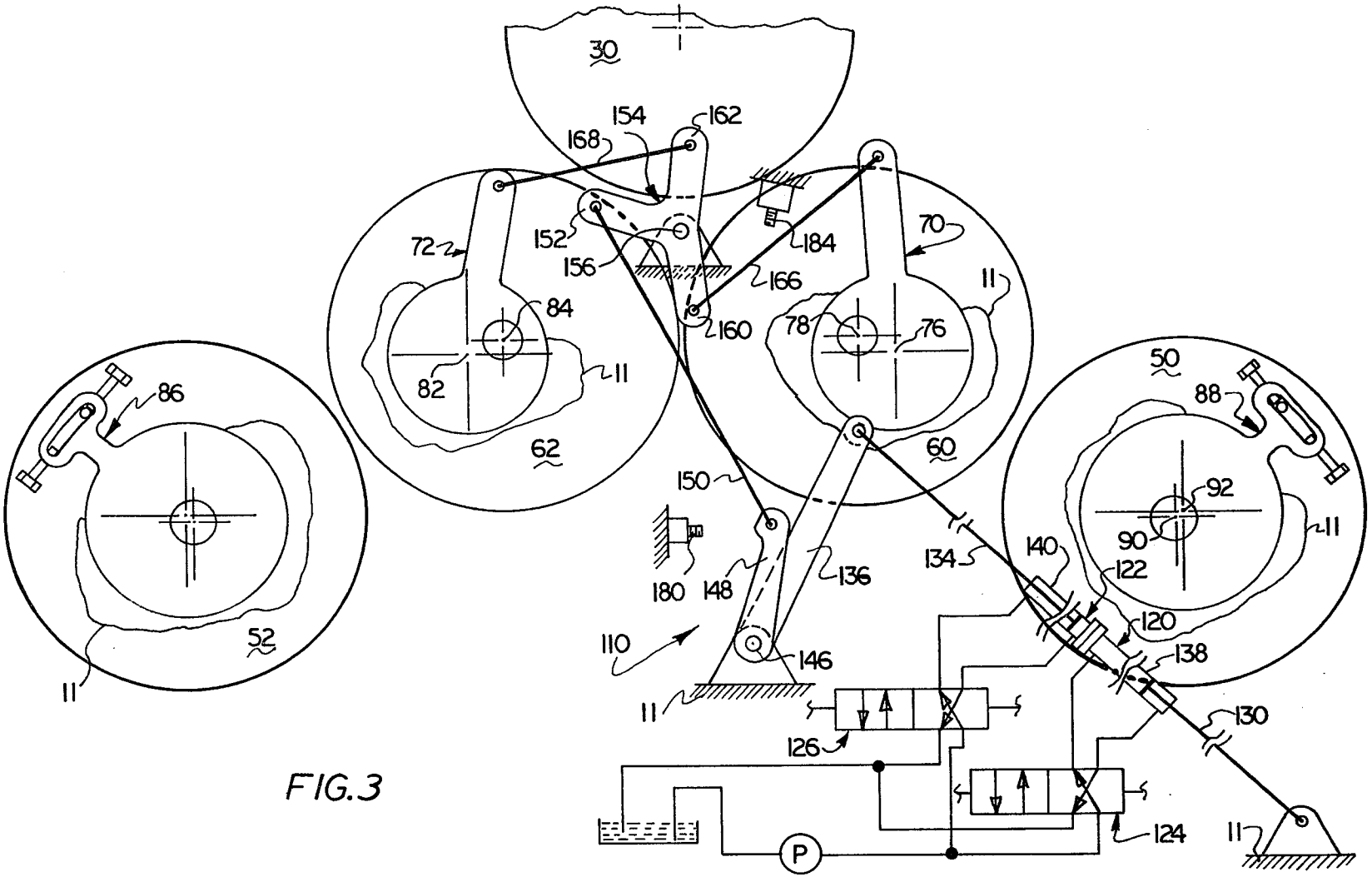
FIG. 3 illustrates the printing cylinders of FIG. 2 in a first throw off position.

FIG. 3 illustrates schematically the positions of the plate cylinders 50 and 52 and the blanket cylinders 60 and 62 when they are set up in the perfecting mode but are in a throw off position. When in this position there is no contact between any of the cylinders, and various maintenance and make ready procedures may be performed on the press, such as mounting printing plates or blankets, cleaning the cylinders, etc.

Figure 5:
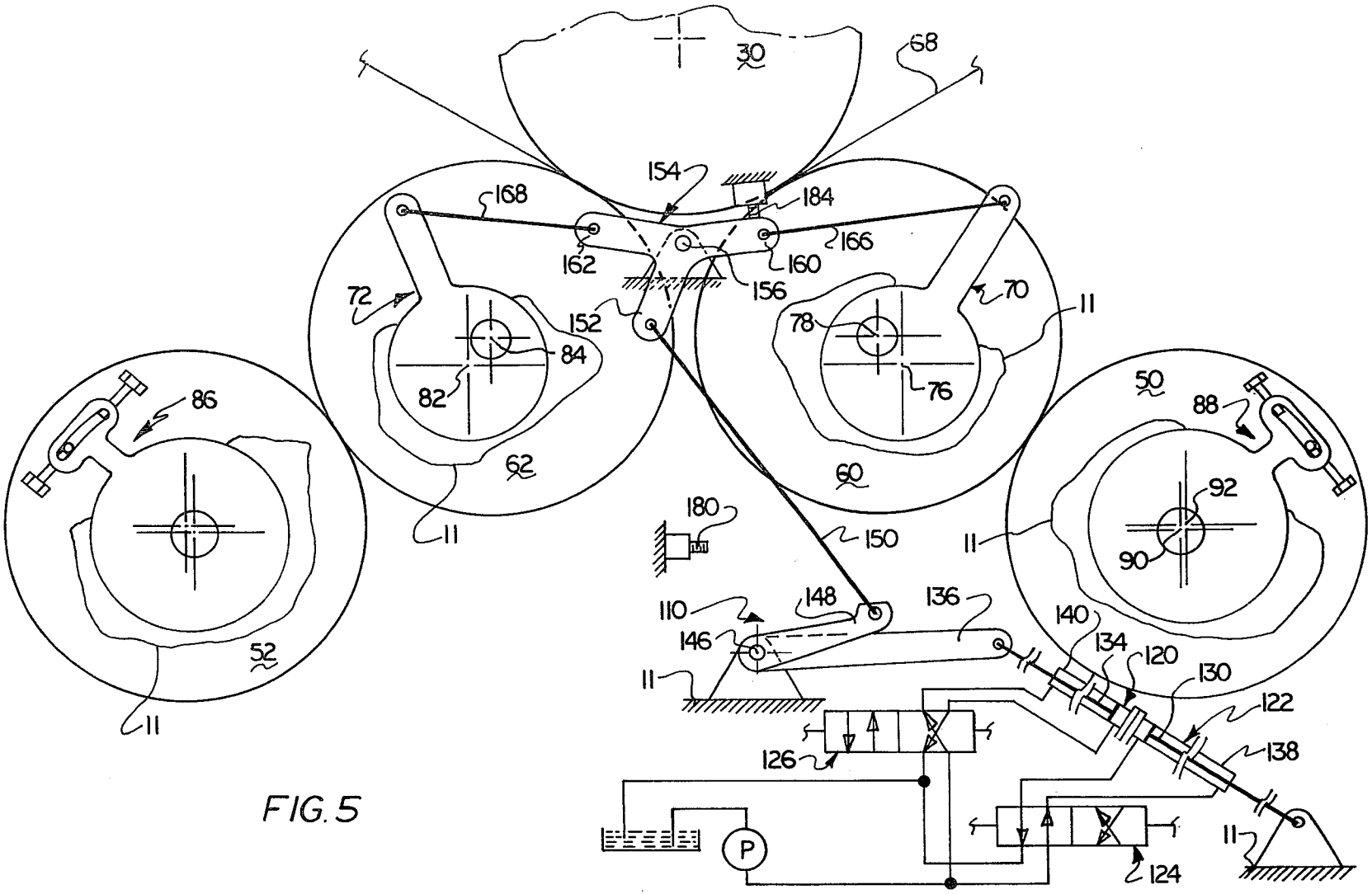
FIG. 5 illustrates the cylinders shown in FIG. 4 in a blanket-to-impression, multicolor printing mode.

Referring to FIG. 5, the plate cylinders 50 and 52 and the blanket cylinders 60 and 62 are shown in a blanket-to-impression or multicolor mode. When the cylinders 50, 52, 60 and 62 are set for printing in this mode, inked impressions are transferred from the blanket cylinders 60 and 62 to the same side of a web 68 which is pressed between the blanket cylinders 60 and 62 and the impression cylinder 30. As shown in FIG. 5, the web 68 has two inked impressions applied to it, one by the blanket cylinder 60 and the other by the blanket cylinder 62. Referring to FIG. 1, it is clear that when the press is set up in the multicolor mode, the web 68 could continue around the impression cylinder 30 to have a third impression applied to the same side of the web by the blanket cylinder 20.

Figure 4:
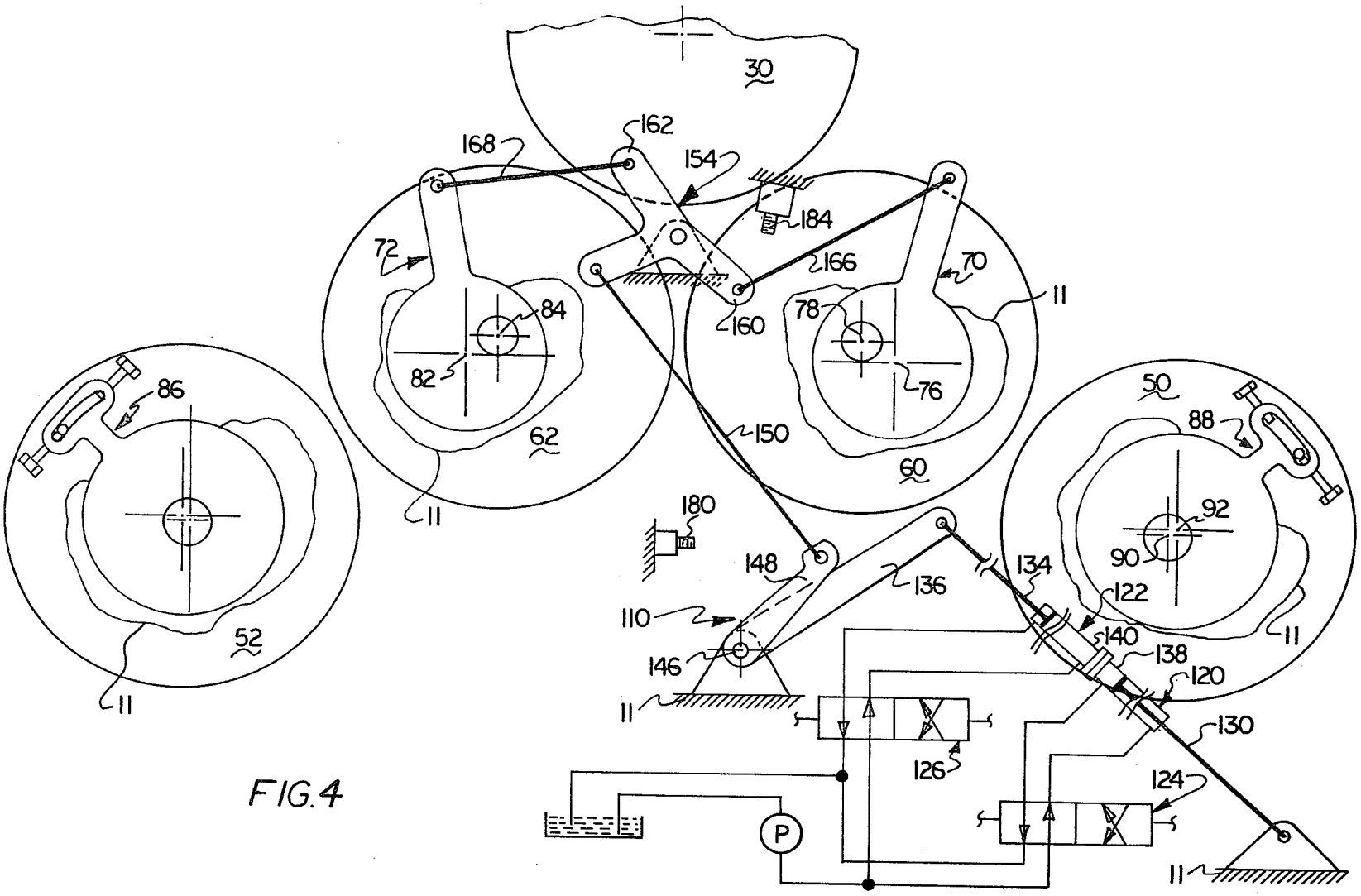
FIG. 4 illustrates a portion of the cylinders of the printing press of FIG. 1 shown in a second throw off position.

FIG. 4 illustrates the plate cylinders 50 and 52 and blanket cylinders 60 and 62 in a throw off position from the multicolor printing mode illustrated in FIG. 5.

Figure 2:
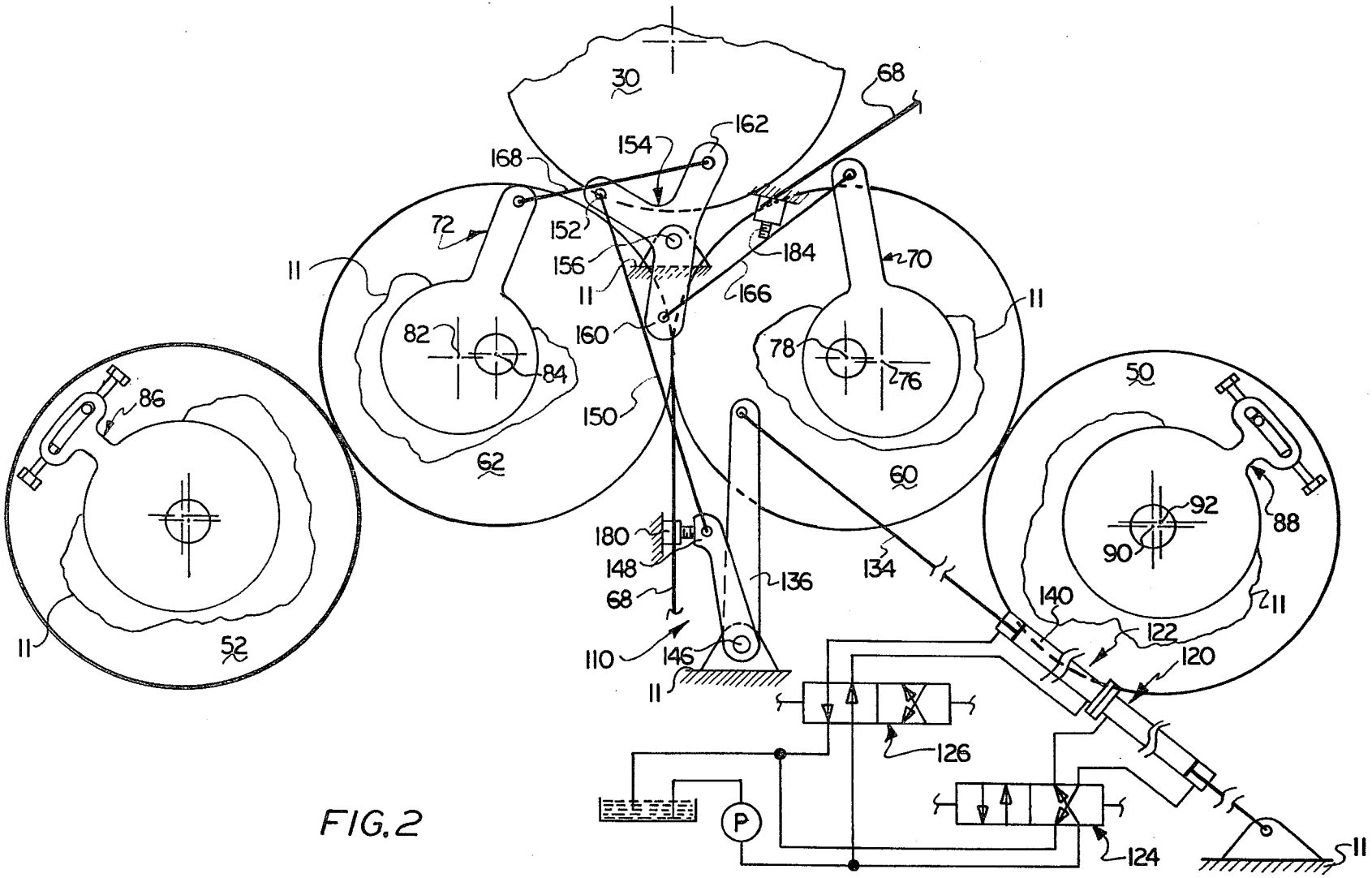
FIG. 2 illustrates a portion of the cylinders of the printing press shown in FIG. 1 in a blanket to blanket, perfecting mode.

The web leads shown in FIGS. 2 and 5 are merely illustrative. FIG. 2 shows the web 68 rising and exiting to the right between the blanket cylinder 60 and the impression cylinder 30. In FIG. 5, the web 68 is shown arriving from the upper right between the impression cylinder 30 and blanket cylinder 60 and exiting to the upper left between the blanket cylinder 62 and impression cylinder 30. However, it is equally possible that the web 68 shown in FIG. 2 could exit to the upper left between the blanket cylinder 62 and the impression cylinder 30, and in FIG. 5 the web could be traveling in the opposite direction.

Figure 10:
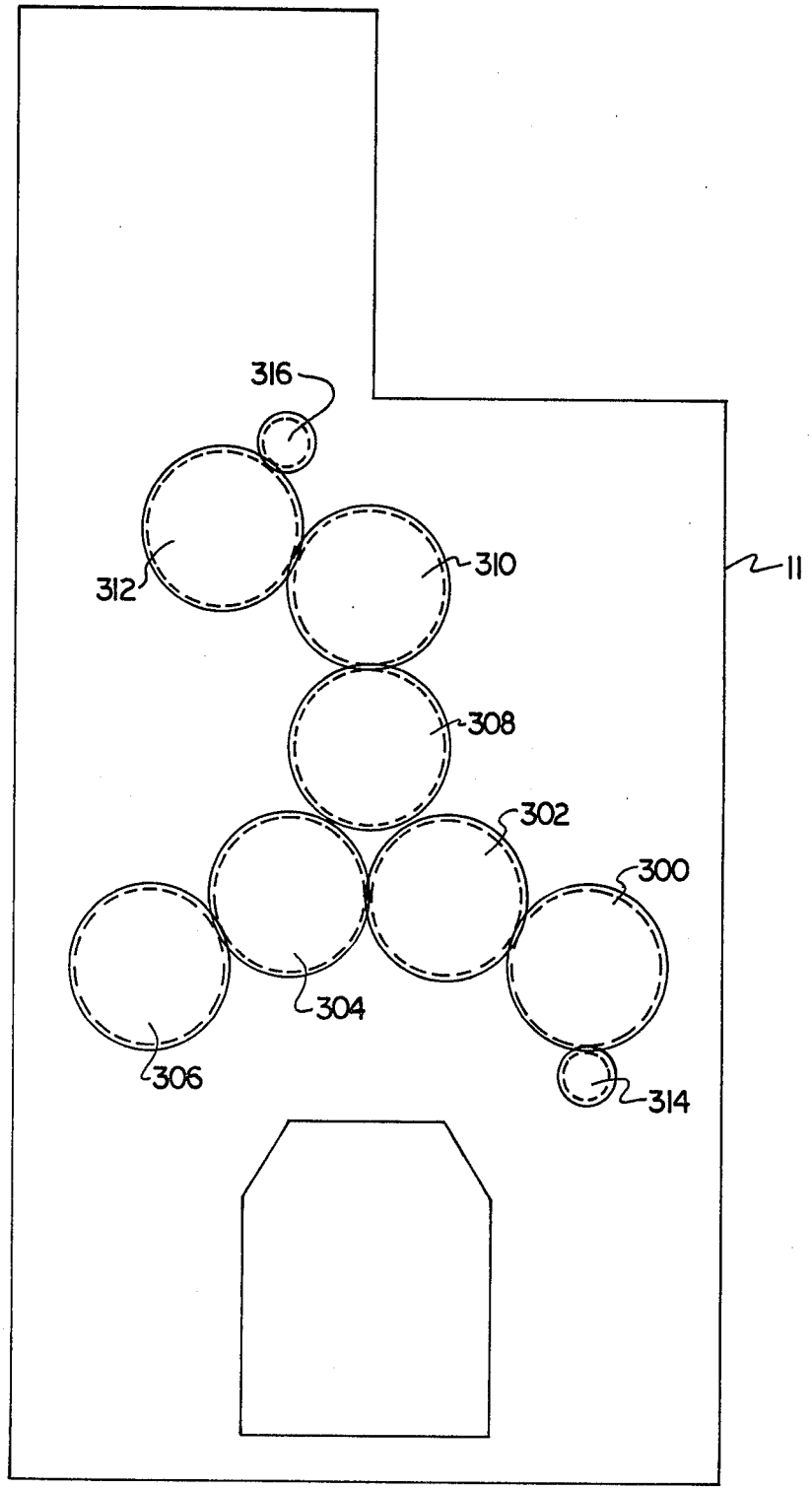
FIG. 10 is a schematic illustration of the gears driving the cylinders of the printing press illustrated in FIG. 1 and also showing a drive gear from the main press drive for driving the lower deck and a drive gear connected with the main press drive for driving the upper deck.

The printing press 10 (FIG. 1) is provided with a suitable reversible drive (not shown) so that, for example, when the cylinders are arranged for printing in the multicolor mode, the direction of motion of the web could be from the upper left to the upper right rather than as illustrated in FIG. 5. Further, if three impressions were being applied to the same side of a web wrapped around the impression cylinder 30, one by blanket cylinder 60, one by blanket cylinder 62, and one by blanket cylinder 20, the web lead and direction of cylinder rotation can be arranged so that any of the three blanket cylinders could apply the first impression to the web. The gears driving the cylinders 18, 20, 30, 50, 52, 60 and 62 are discussed more fully below in connection with FIG. 10.

As noted above, both the blanket cylinders 60 and 62 and the plate cylinders 50 and 52 are shifted to change from the perfecting mode of printing illustrated in FIG. 2 to the multicolor mode of printing shown in FIG. 5. The shifting of the blanket cylinders 60 and 62 is accomplished by mounting the cylinders in eccentric bushings 70 and 72 (FIG. 6) in the press frame 11. The eccentric 70 has a cylindrical outside surface 74 which is centered about an axis 76 and which is rotatably received in a corresponding cylindrical passage or bearing in the press frame 11. The blanket cylinder 60 is rotatably mounted in the eccentric 70 about an axis 78 which is parallel to but offset from the axis 76 about which the eccentric rotates. When the eccentric 70 is turned about its axis 76, the axis of rotation 78 of the blanket cylinder 60 is caused to move along a circular or arcuate path having a radius equal to the distance between the two axes 76 and 78.

Figure 6:
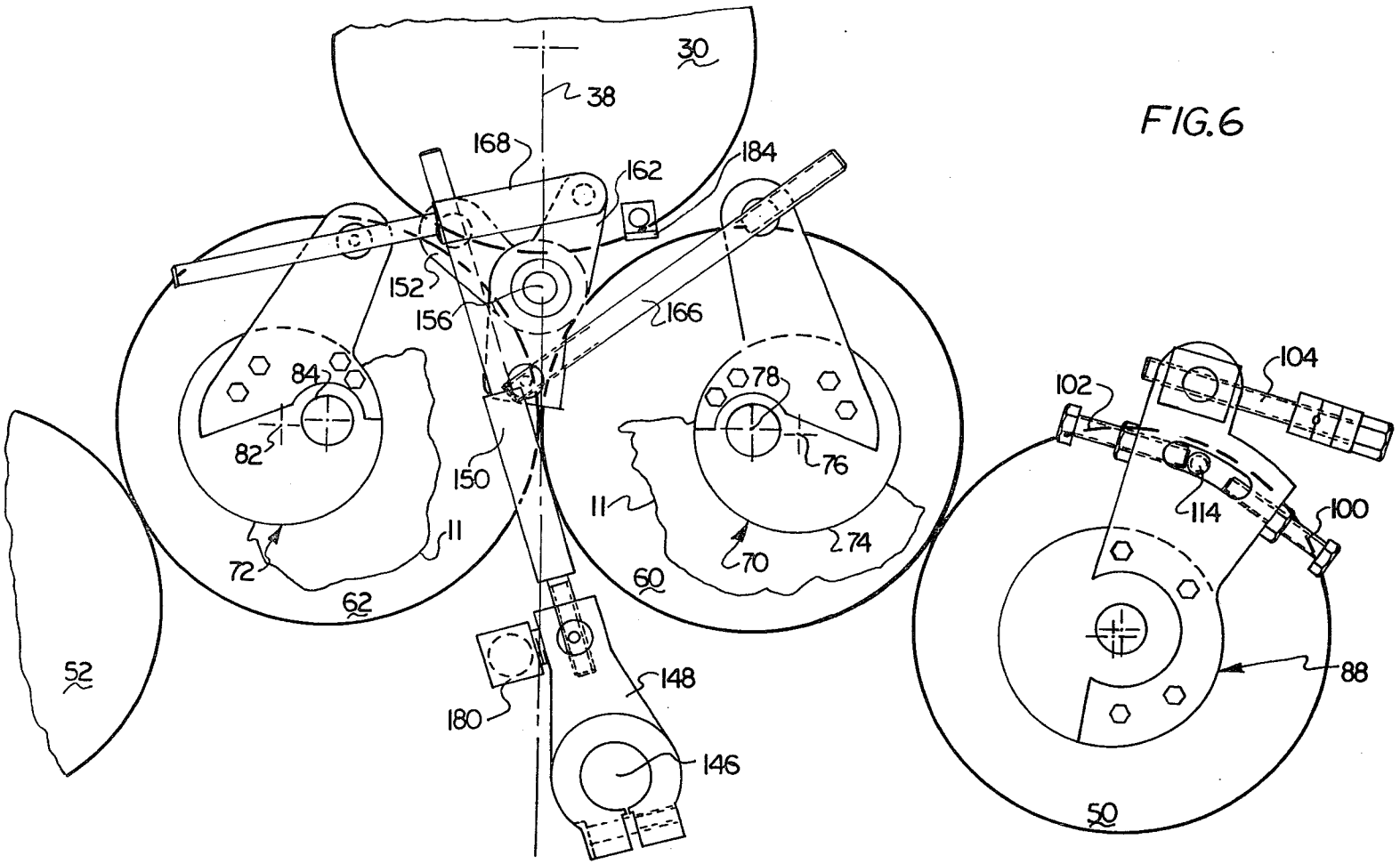
FIG. 6 is partially schematic illustration of the cylinder shifting mechanism used to shift the lower deck blanket cylinders and of the eccentrics used to shift the lower deck plate cylinders of the printing press in FIG. 1.

In FIG. 6 and in the other Figures the proportions between various components of the eccentric mechanisms have been distorted from their true proportions in order to clarify the operation of these parts. For example, the stub shaft centered about center 78 is in reality, of a substantially larger diameter than that shown, as will be readily understood by those familiar with the design of printing presses. Moreover, other types of mechanisms are possible for shifting the cylinders. For example, the above-mentioned French Pat. No. 1,257,552 shows double eccentrics for shifting cylinders. This and other equivalent mechanisms do move the cylinders along arcuate or curved paths, although the paths may not be circular, and could, in the limit, approach being straight.

The eccentric 72 is similar to the eccentric 70, and when it is turned about its own axis 82, the axis 84 of the cylinder 62 is caused to move along a circular or arcuate path whose radius is equal to the distance between the two axes 82 and 84. The eccentrics 70 and 72 are centered equidistant from the vertical center line 38, and thus the paths described by the centers 78 and 84 of the blanket cylinders 60 and 62 when the eccentrics are rotated are symmetrical about the vertical centerline 38. Although the described embodiments of the present invention are generally symmetrical, symmetry is not essential to the present invention. It is contemplated that the lower deck could be made asymmetric about a vertical centerline.

The plate cylinders 50 and 52 are likewise mounted in eccentrics 86 and 88 (FIG. 2) which are rotatable to shift the positions of the plate cylinders. The eccentric 88 mounting the plate cylinder 50 is shown in detail in FIG. 6, however a symmetrical eccentric mechanism 86 is provided for shifting the position of the plate cylinder 52. The center of rotation of the eccentric 88 (FIG. 6) in which the plate cylinder 50 is mounted is shown at 90, while the axis of rotation of the plate cylinder 50 is shown at 92. Accordingly, when the eccentric 88 is rotated, the axis of rotation 92 of the plate cylinder 50 shifts along a circular or arcuate path which is centered about the axis 90 and which has a radius equal to the distance between the parallel axes 90 and 92. Adjustable stops 100 and 102 limit the extent of angular movement of the eccentric 88 and a threaded shaft 104 is turned to cause the eccentric 88 to turn.

Figure 9:
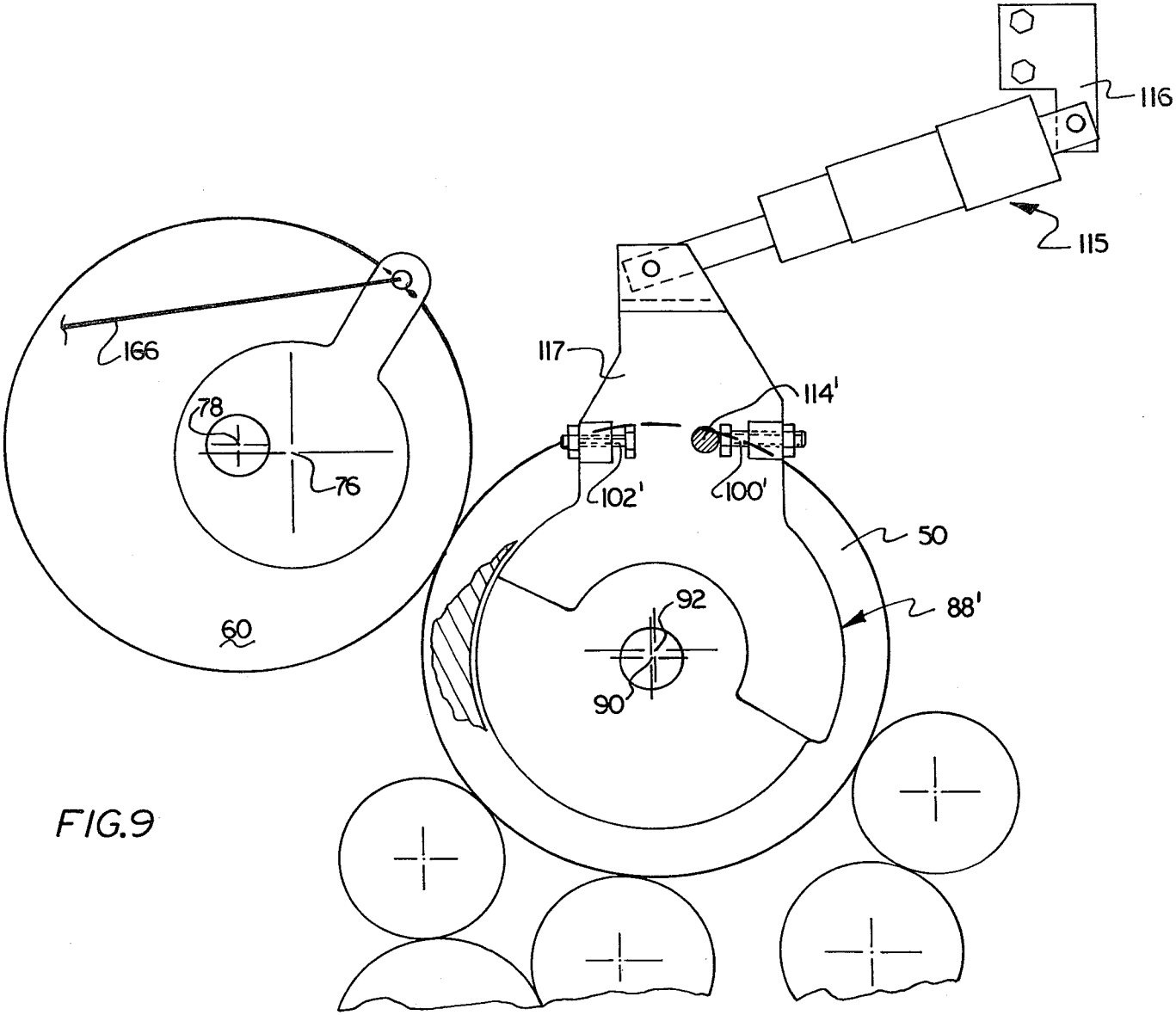
FIG. 9 illustrates an alternate to the mechanism for shifting a plate cylinder shown in FIG. 6.

A manual shifting of the plate cylinders 50 and 52 by means of threaded shaft 104 is described above. However, automatic shifting can also be effected. Such an embodiment is shown in FIG. 9. In FIG. 9 identical numerals have been used to indicate identical parts, and numerals with a prime (') have been used to identify parts which are similar to parts in the embodiment having a manual plate cylinder shifting mechanism.

When an automatic mechanism is used to rotate the eccentric, an electrical linear actuator 115 is utilized. One end portion of the actuator 115 is pivotably mounted by means of a bracket 116 to the press frame 11 (not shown in FIG. 9). The other end portion of the actuator 115 is pivotably connected with a bracket 117 which is secured to the eccentric 88'.

The linear actuator 115 is a commercially available device which may be purchased from Warner Electric Company. It includes a reversible electric motor and a brake which are connected with a nut and threaded rod arrangement. Actuation of the motor in one direction causes the actuator 115 to expand axially, and actuation of the motor in the reverse direction causes the actuator to contract axially.

When the linear actuator 115 is actuated it causes the bracket 117 and eccentric 88' to rotate about the center of rotation 90 of the eccentric. Movement is limited by the adjustable stops 100' and 102' which abut the pin 114' which is fixed to the press frame (not shown).

It will be understood by those skilled in the art that the cylinders 50, 52, 60 and 62 are each mounted in a pair of eccentrics, one of each pair being mounted on the so-called work side of the press, and the other of each pair of eccentrics being mounted on the so-called gear side of the press.

In FIGS. 2–5, the eccentrics which mount the plate cylinders 50 and 52 and the eccentrics which mount the blanket cylinders 60 and 62 have been shown schematically, and a schematic illustration of the linkage mechanism 110 utilized to shift the blanket cylinders 60 and 62 is also shown. When shifting from the blanket-to-blanket, perfecting mode illustrated in FIG. 2 to the blanket-to-impression, multicolor mode illustrated in FIG. 5, both the blanket cylinders 60 and 62 must be moved, and the plate cylinders 50 and 52 must also be moved. For example, to shift the cylinders from the blanket-to-blanket perfecting mode shown in FIG. 6 to the multicolor mode, the eccentrics 70 and 72 are rotated to shift the blanket cylinders 60 and 62, respectively, to the multicolor, blanket-to-impression mode. The eccentric 88 in which the plate cylinder 50 is mounted and the corresponding eccentric 84 are also shifted.

To rotate the eccentric 88 to shift the plate cylinder 50, the shaft 104 is turned until the stop 100 abuts a pin 114 which is fixed to the press frame. The eccentric 84 in which the plate cylinder 52 is mounted is the mirror image of the eccentric 88 and operates in a similar fashion. When shifting from the multicolor mode to the perfecting mode, the cylinder movement is reversed.

As noted above the printing press 10 includes two throw off positions. The throw off position shown in FIG. 3 illustrates the cylinders when they have been retracted from the blanket-to-blanket printing mode illustrated in FIG. 2. When throwing off the cylinders from the blanket-to-blanket mode, only the blanket cylinders need to be shifted. The plate cylinders 50 and 52 remain in the position corresponding to blanket-to-blanket mode and illustrated in FIGS. 2 and 3. Likewise, to shift from the blanket-to-impression, multicolor mode illustrated in FIG. 5 to the throw off position illustrated in FIG. 4, only the blanket cylinders 60 and 62 need to be moved, and the plate cylinders 50 and 52 remain in the position which corresponds to the blanket-to-impression printing position illustrated in FIGS. 4 and 5.

A linkage 110 (FIG. 2) is used to shift the positions of the blanket cylinders. The linkage 110 is operated by a motor comprising tandem air cylinder assemblies 120 and 122 and the associated control circuits 124 and 126. A piston 130 of air cylinder assembly 120 is pivotably connected with the machine frame 11. Another piston 134 of air cylinder assembly 122 is pivotably connected to crankarm 136. The cylinders 138 and 140 of the cylinder assemblies 120 and 122, respectively, are connected back-to-back with each other.

The control circuits 124 and 126 for the air cylinder assemblies 120 and 122, provide only an on/off supply of air which is reversible from one side of the piston to the other. The fully extended lengths of the air cylinder assemblies 120 and 122 are different, and thus it is possible to achieve four discrete overall lengths for the tandem air cylinder assemblies. This is accomplished by (1) extending both pistons as illustrated in FIG. 2; (2) retracting piston 134 while piston 130 remains extended as shown in FIG. 3; (3) extending the piston 134 and retracting piston 130 as illustrated in FIG. 4; and (4) retracting both pistons 130 and 134 as illustrated in FIG. 5. The four different lengths of the tandem air cylinder assemblies 120 and 122 cause the linkage mechanism 110 to shift the blanket cylinders 60 and 62 between their four different positions.

If the automatic plate cylinder shifting mechanism shown in FIG. 9 is used, a control circuit for the plate throw off actuator 115 and the control circuits 124 and 126 may be integrated to provide automatic operation of the cylinders shifting eccentrics. Such an integrated control circuit is easily constructed by one of ordinary skill in the control art.

The linkage assembly 110 includes crankarm 136 which is connected with the piston 134. The crankarm 136 is fixedly connected to a shaft 146 which is rotatably mounted in the frame 11. Also connected to the shaft 146 is a second crankarm 148 which is shown in FIG. 2 and can also be seen in FIG. 6. A drive link 150 is pivotally connected between one end portion of the crankarm 148 and one branch 152 of a Y-shaped link 154. The remaining two branches 160 and 162 of the Y-shaped link 154 are connected by links 166 and 168, respectively, to the eccentrics 70 and 72. The Y-shaped link 154 is mounted for rotation in the frame 11 about axis 156 which is spaced from the connections between the Y shaped link and the links 150, 166 and 168.

The shaft 146 extends from the work side of the press to the gear side of the press. There is a crank arm similar to the crank arm 148 on the opposite side of the press which is connected with linkage and the eccentrics (not shown) mounted on the opposite side of the press. When the crank arm 136 rotates the shaft 146, both the crank arm 148 (shown) and the crank arm on the opposite side of the press (not shown) rotate simultaneously. This effects simultaneous movement of the eccentrics mounting each end of each blanket cylinder 60 and 62.

It will be observed that when the tandem air cylinder assemblies 120 and 122 are actuated to each of the four different lengths, the motion is transmitted through the linkage assembly 110 and causes the blanket cylinders 60 and 62 to shift between the various positions by rotating the eccentrics 70 and 72.

When the tandem air cylinder assemblies 120 and 122 are both in their extended positions, the blanket cylinders 60 and 62 cooperate with each other in the perfecting, or blanket-to-blanket position. The exact amount of the extension of the pistons 130 and 134, and therefore the exact position of the blanket cylinders 60 and 62 when they are in the perfecting mode is determined by adjustable stop 180. The stop 180 abuts the crankarm 148 and limits the extent of its rotation in a counterclockwise direction as viewed in FIG. 2.

The lengths of the drive link 150 and the crankarm 148 are selected to provide a toggle type action when the blanket cylinders 60 and 62 are in the perfecting position. These elements are arranged so that the pivot connection between arm 152 and drive link 150, the pivot connection between drive link 150 and crankarm 148, and the center of shaft 146 lie in a nearly straight line.

The air pressure in cylinders 138 and 140 causes the pistons 130 and 134 to extend, but the exact length and amount of this extension is determined by the position of the stop 180 and the geometry of the linkage 10, and therefore the length of the maximum extension of piston 134 is not critical. The stop 180 may be adjusted to select the exact limit of the motion of the blanket cylinders 60 and 62, and the linkage 110 is designed so that the adjustment will be correct when the link 150 and crank arm 148 have moved nearly to or just over center as described above.

When the piston 134 is retracted (FIG. 3) and the piston 130 remains extended, the blanket cylinders 60 and 62 move to a throw off position. The minimum length of the cylinder assembly 122 determines where the linkage mechanism 110 will be in this throw off position because there are no stops which define this throw off position.

Similarly, when the piston 134 is fully extended and the piston 130 is fully retracted as shown in FIG. 4, the cylinders 60 and 62 are in a throw off position for the blanket to impression, multicolor printing mode. When the pistons 130 and 134 are in this position there are no stops against which any part of the linkage 110 abuts, and the position of the linkage and of the blanket cylinders 60 and 62 is determined by the strokes of the tandem air cylinder assemblies 120 and 122.

As the air cylinder assemblies 120 and 122 are shifted from the position shown in FIG. 4 to the position illustrated in FIG. 5 in which both pistons 130 and 134 are in their fully retracted positions, the blanket cylinders 60 and 62 move into cooperation with the impression cylinder 30 by the linkage 110. An adjustable stop 184 limits the extent of rotation of the Y-shaped link 154 in the counterclockwise direction (as viewed in FIGS. 2–5) and thereby determines the position of the blanket cylinders 60 and 62 in the blanket to impression, multicolor printing mode.

The Y-shaped link 154 is shaped to provide an over center toggle action when the blanket cylinders 60 and 62 are in the multicolor printing position illustrated in FIG. 5. The toggle action in the multicolor mode and in the perfecting mode assists in holding the blanket cylinders 60 and 62 firmly and positively in the desired positions despite vibrations or other forces which could cause them to change positions during high speed printing. When in the multicolor mode, the pivotable connection between arm 160 and link 166 lies nearly along a line connecting the pivotal link between eccentric 70 and link 166 and the pivot axis 156 of the Y-shaped link 154.

Thus, the linkage 110 provides over-center toggling action to maintain the blanket cylinders 60 and 62 in the two printing positions (FIGS. 2 and 5). When the two blanket cylinders 60 and 62 are thrown off from the printing positions they need not be so exactly located as in the printing positions, and there are no vibrations generated by contact with other cylinders which need to be suppressed. Accordingly, in the throw off positions no toggle action is required or provided.

The adjustable stops 180 and 184 serve an additional function. The cylinders 30, 60, 62, 50 and 52 may be equipped with bearers (not shown). Bearers are conventional in the printing art, and serve in part to reduce cylinder bounce caused by gaps in the cylinder surfaces in which plate and blanket lockups are located. The bearers are hardened metal cylindrical surfaces mounted at opposite ends of the cylinders 18, 20, 30, 50, 52, 60 and 62. When a pair of cylinders, e.g., 50, 60 (FIG. 2), touch each other, the bearers on these cylinders are in rolling contact with each other. By limiting the movement of the linkage 110 in the extreme positions (FIGS. 2 and 5) the stops 180 and 184 serve to limit the maximum pressure forces acting between cooperating bearers. If the pressure force acting between cooperating bearers is too high, the result can be excessive, rapid wear of the bearers and deteriorated print quality.

The movement of the blanket cylinders 60 and 62 between the blanket-to-blanket, perfecting position illustrated in FIG. 2 and the blanket-to-impression, multicolor printing position shown in FIG. 5 and the two intermediate throw off positions illustrated in FIGS. 3 and 4 achieves automatically the movement of the drive gears 300–312 (FIG. 10) which are connected with each of the cylinders 50, 52, 60, 62, 30, 18 and 20, respectively. Moreover, the provision of a separate throw off position for each of the two printing modes permits the proper gears to remain in engagement while the cylinders are thrown off from each other to facilitate make ready operations. Because the cylinders 60 and 62 rotate in the same direction when they are used for multicolor printing, and in opposite directions when they are set for perfecting printing, two separate throw off positions are required. When the press 10 is set in the perfecting mode (FIG. 1) the blanket cylinders 60 and 62 rotate in opposite directions, and drive of the cylinders 60 and 62 is achieved through meshing engagement of gears 302 and 304 which are fixed to cylinders 60 and 62 in the conventional way. The main press drive is connected with plate cylinder 50 through gear 314 and power is transmitted from gear 300 connected to cylinder 50 to gear 302 to blanket cylinder 60. When the press is set up in the perfecting mode as shown in FIG. 2, gear 302 mounted on cylinder 60 is in meshing engagement with the gear mounted on cylinder 62, and the gear 304 on cylinder 62 is in meshing engagement with the gear on cylinder 52. In this way power is transmitted from the gear 300 on cylinder 50 to that on cylinder 60 to that on cylinder 62 to the plate cylinder 52. Because the gears 302 and 304 on cylinders 60 and 62 are in engagement with each other, these cylinders rotate in opposite directions.

When the cylinders 60 and 62 are in the positions shown in FIG. 2 for perfecting printing, the gears on cylinders 60 and 62 are in meshing engagement along their pitch lines. Likewise, the engagement between the gear 300 and plate cylinder 50 and the gear 302 connected blanket cylinder 60 is along their pitch lines, and the engagement between the gears mounted on plate cylinder 52 and blanket cylinder 62 (304 and 306) is also along their pitch lines. When the cylinders are shifted to the throw off position shown in FIG. 3, the gears connected with cylinders 50, 60, 62, and 52 move with the cylinders but are still in meshing engagement although not along their pitch lines. This is necessary to facilitate make-ready operations in which the press cylinders are jogged or run at low speeds.

When the press is shifted to the multi-color mode shown in FIG. 5 there is no longer meshing engagement between the gears 302 and 304 on cylinders 60 and 62, respectively. Instead, the gear 302 mounted on cylinder 60 is in meshing engagement with a gear 308 mounted on the impression cylinder 30, and the gear 304 mounted on blanket cylinder 62 is also in meshing engagement with the gear 308 mounted on the impression cylinder 30. Power thus is transmitted from gear 300 mounted on plate cylinder 50 through gear 302 mounted on blanket cylinder 60 to gear 308 mounted on impression cylinder 30 to gear 304 mounted on blanket cylinder 62 and finally to gear 306 mounted on plate cylinder 52. When the cylinders are in the blanket-to-blanket, multicolor printing positions, all of the above gears are in meshing engagement along their pitch lines where they are best able to transmit loads. When the cylinders are moved to the throw off position illustrated in FIG. 4, power is still transmitted through gear 302 connected with blanket cylinder 60 to gear 308 connected with impression cylinder 30 and thence to gear 304 connected with blanket cylinder 62, and there is no contact between gear teeth of the gear connected with cylinder 60 and the gear 304 connected with cylinder 62. When the cylinders are in this throw off position from the multi-color printing position illustrated in FIG. 5, it is possible to jog the press for make-ready operations with all of the cylinders rotating in the direction in which they will rotate during printing and in proper synchronism with each other.

The drive gear 308 is connected with the impression cylinder 30 by means of a disengageable clutch. When the blanket cylinders 60 and 62 are shifted between printing modes, it is necessary to retime the cylinders so that the gaps in the cylinder 60 and 62 in which the plate lock up mechanisms are located will be in proper synchronism with each other. Synchronism is assured by timing marks located on each of the gears 302, 304 and 308 and corresponding marks on the machine frame.

The upper deck plate and blanket cylinders 18 and 20, respectively, have attached thereto gears 310 and 312. Drive to the upper deck may be through gear 316 which is driven from the main press drive. Drive is supplied through gear 316 when the lower deck is being operated in a perfecting mode and it is also desired to run a separate web between impression cylinder and blanket cylinder 20. However, drive gear 316 is disengaged from the main press drive when the press is set in a multicolor mode.

As mentioned above, the plate cylinders 50 and 52 (FIGS. 1 and 7) must also be shifted when changing between printing modes. This shifting of the plate cylinders 50 and 52 requires that the inkers 40 and 42 and dampers 44 and 46 also shift positions. The present invention includes a form following mechanism (shown in FIGS. 7 and 8. The form following mechanism enables the form rollers 202 and 204 of the inker 40 and the form roller 206 of the damper 44 to follow the movement of the plate cylinder 50 when it is shifted between the position for blanket-to-blanket, perfecting printing and blanket-to-impression, multicolor printing. A similar mechanism is used with the inker 42 and damper 46 (FIG. 1) to permit the form rollers of these mechanisms to follow the plate cylinder 52. However, only the form following mechanism used on the plate cylinder 50 will be described in detail, and it will be understood that the description also applies to the mechanism utilized on the other side of the press 10.

As is well known in the art, the form rollers 202, 204 and 206 are relatively soft, and the amount of water or ink transferred from the form rollers to the plate cylinder 50 is related to the force with which the form rollers are biased against the plate cylinder. When the relatively soft form rollers 202, 204 and 206 are biased into engagement with the plate cylinder 50, they deform slightly forming a flat on their perimeter where there is contact between the form roller and the plate cylinder. It is necessary to preserve the "flat" adjustment when the plate cylinders 50 and 52 are moved if printing quality is not to be disturbed.

Figure 7:
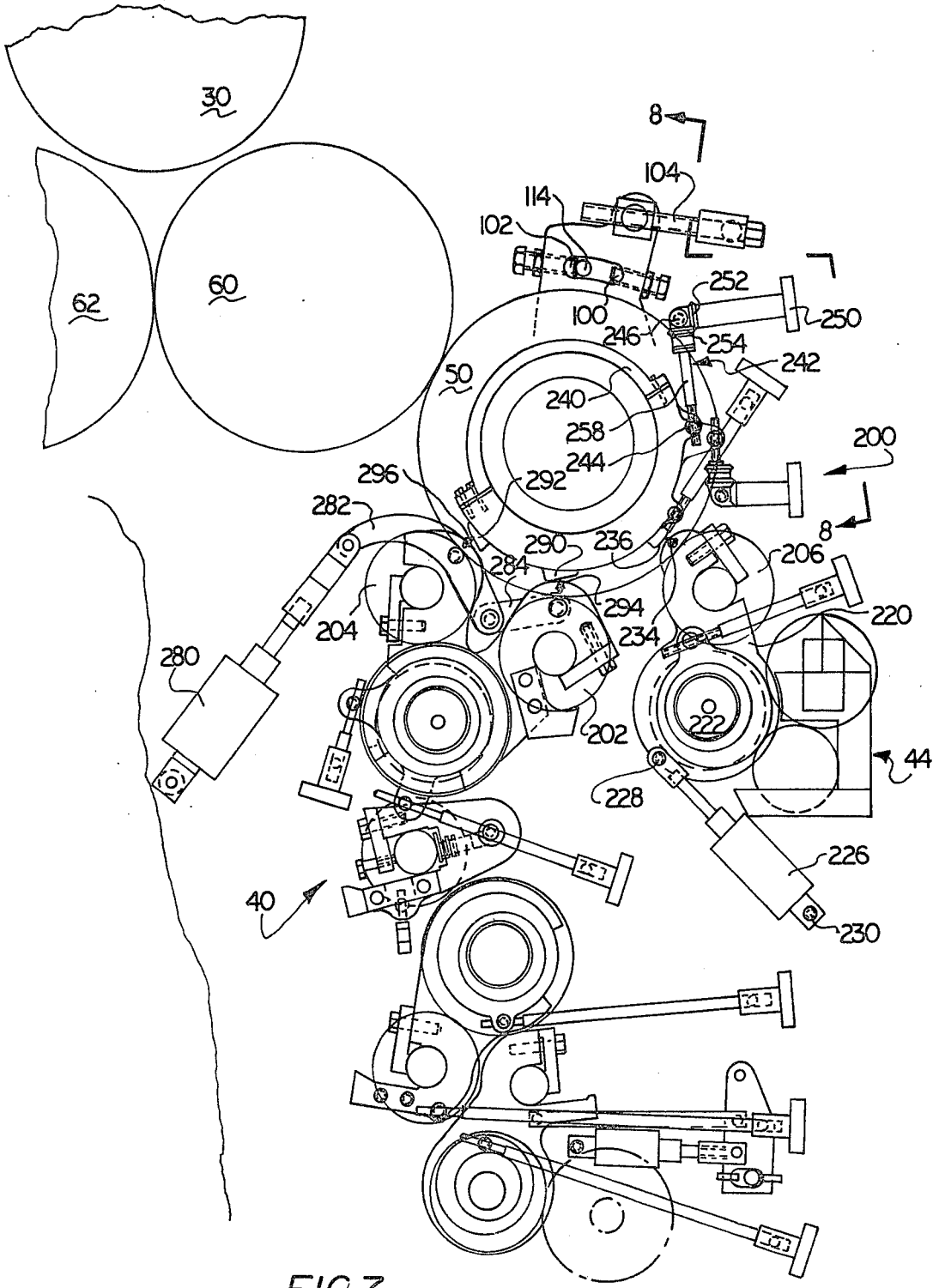
FIG. 7 is a partially schematic illustration of a shifting mechanism used to shift a lower deck plate cylinder of the printing press shown in FIG. 1 and of a cam and follower mechanism by which the form rollers are preserved in adjustment when the plate cylinder is shifted.
Figure 8:
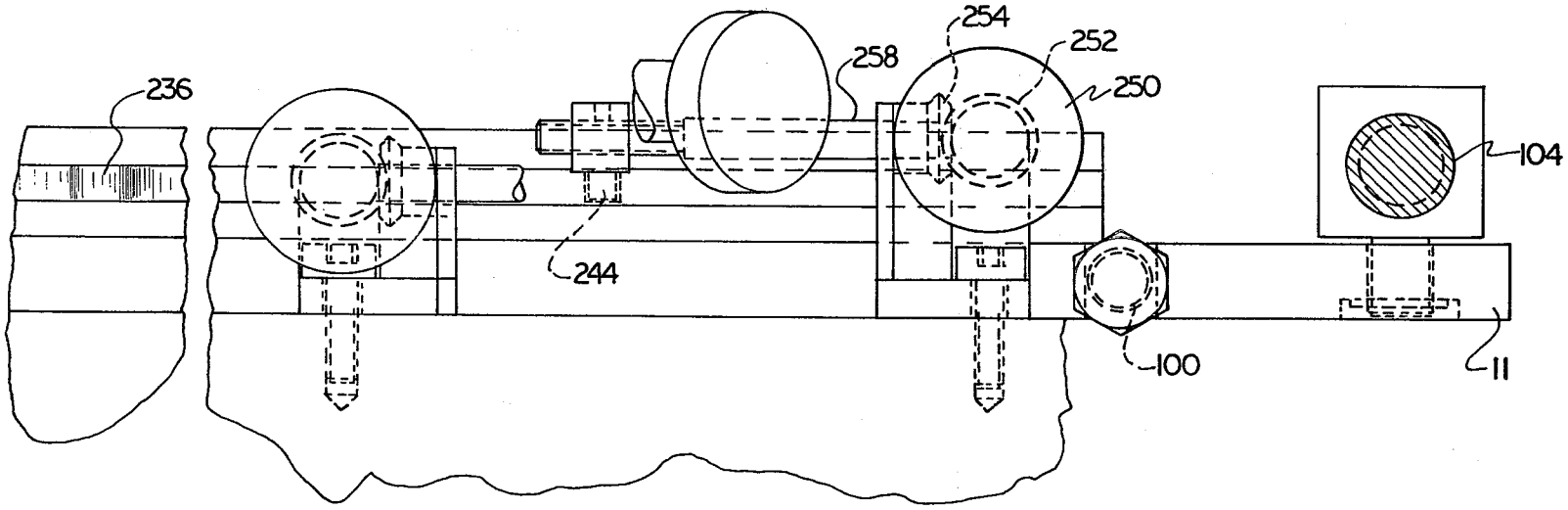
FIG. 8 is a partly schematic illustration of the follower mechanism taken along line 8—8 of FIG. 7.

The form following mechanism permits the plate cylinder 50 to be shifted from the blanket-to-blanket, perfecting position illustrated in FIG. 7 to the position for multicolor printing (FIG. 5) without the requirement for readjustment of the flats of the form rollers. The mechanisms associated with each of the form rollers 202, 204 and 206 are generally similar and consequently only the mechanism associated with the damper 44 and the differences between it and the mechanisms associated with the two form rollers 202 and 204 of the inker 40 will be discussed in detail.

The form roller 206 is mounted in a bracket 220 which is pivotal about an axis 222. An air cylinder 226 is pivotably connected to the bracket 220 at 228 and to the frame of the press at 230. The air cylinder 226 may be actuated by a control circuit (not shown) to throw the form roller 206 off the plate cylinder 50 for make-ready and start up of the press. The bracket 220 is also provided with a cam follower 234 which engages a cam surface 236 on a cam ring 240. The cam surface 236 is inclined relative to the surface of the plate cylinder 50, and when there is relative movement between the cam surface and the cam follower 234, the flat formed between the form roller 206 and the plate cylinder 50 is varied.

The cam ring 240 is mounted for rotation about the axis 92 of the plate cylinder 50. Thus, when the plate cylinder 50 is shifted from the blanket-to-blanket position shown in FIG. 7 to the position for multicolor printing illustrated in FIG. 5, the center of rotation of the cam ring 204 moves also.

The rotation of the cam ring 240 about is central axis is controlled by an adjustable link assembly 242 which is pivotally connected with the cam ring at 244 and to the frame of the printing press at 246. The knob 250 acts through bevel gears 252 and 254 to rotate the axially extending link 258. The link 258 makes a threaded and pivotal connection with the cam ring 240 at 244, and when it is rotated the distance between the points 244 and 246 changes. Therefore when the knob 250 is rotated, the inclined surface of the cam 236 shifts with respect to the cam follower 234, and the form roller 206 moves relative to the plate cylinder 50. In this way the flat of the form roller 206 can be adjusted.

Relative movement between the cam surface 236 and the cam follower 234 also occurs when the plate cylinder is shifted from the blanket-to-blanket, perfecting position to the blanket-to-impression, multicolor position. This is because the cam ring 240 rotates about the central axis 92 of the plate cylinder 50 and moves with that central axis as the plate cylinder 50 is shifted. However, the adjustable link assembly 242 has one end 246 fastened to the frame of the press and the other end 244 fastened to the cam ring 240. When the central axis 92 of the plate cylinder 50 is, for example, shifted in a clockwise direction about the center 90 of the eccentric 88, the adjustable link assembly 242 holds the cam ring 240 and causes it to move in a counterclockwise direction relative to the plate cylinder 50.

The flat formed between the form roller 206 and the plate cylinder 50 remains unchanged when the cylinder is shifted because of careful selection of the shape of the cam surface 236. In particular, the shape of the cam surface 236 compensates for the motion of the plate cylinder 50. The relative counterclockwise motion between the cam ring 240 and the plate cylinder 50 as the plate cylinder is moved in a clockwise direction allows the cam follower 234 to move to a portion of the cam surface which is closer to the center 92 of the plate cylinder 50 by a distance which equals the distance by which the center 92 of the plate cylinder 50 had moved away from the form roller 206. In this way the two motions compensate for one another and the flat formed on the form roller 206 remains the same while the position of the plate cylinder 50 is changed.

From FIG. 7 it should be clear that the inker 40 includes a similar mechanism for adjusting the form rollers 202 and 204. The primary difference is that a single air cylinder 280 is used to throw off both the ink form rollers 202 and 204 through a linkage mechanism including links 282 and 284. In addition, the cam surface 290 which controls the flat of the form roller 202 and the cam surface 292 which controls the flat of the form roller 204 differ in shape from the cam 236 which controls the flat on the form roller 206 because of their different angular positions around the center 92 of the plate cylinder. However, the mode of cooperation between the cam surfaces 290 and 292 and the respective cam followers 294 and 296 is the same as the mode of operation of the cam surface 236.

Thus it is clear that the present invention provides a web fed offset printing press 10 (FIG. 1) which has two printing modes, a perfecting mode and a multicolor mode. The press 10 has a single impression cylinder and three printing couples 12, 34 and 36, each with a blanket cylinder 20, 60, 62, a plate cylinder 18, 50, 52 and the necessary inkers and dampers 22, 24, 40, 42, 44, 46. The press is arranged in an upper deck 12 with one printing couple and a lower deck 14 with two printing couples. The printing units in both the upper deck 12 and the lower deck 14 share a common impression cylinder which rotates about a fixed axis.

According to the present invention the lower deck plate cylinders 50, 52 and blanket cylinders 60, 62 are all mounted in eccentrics 70, 72, 86, 88 (FIG. 2). This permits the lower deck printing units 34, 36 to be shifted between a perfecting mode of printing in which the blanket cylinders 60, 62 print on opposite sides of a web 68 pressed between them and a multicolor mode (FIG. 5) in which the blanket cylinders both print on the same side of a web pressed against the fixed impression cylinder 30. Mounting both the lower deck blanket cylinders 60, 62 and the lower deck plate cylinders 50, 52 in eccentrics permits a larger distance between the impression cylinder 30 and the two, shiftable blanket cylinders 60, 62 when the press is in its perfecting mode, and thereby reduces jamming.

The plate cylinder eccentrics 86, 88 are individually actuatable while the blanket eccentrics 70, 72 are actuated by a mechanism 100 (FIG. 2) which forms another important aspect of the present invention. The shifting mechanism 100 of the blanket cylinders 60, 62 provides both a throw off mechanism and means for shifting these cylinders between the two printing modes without requiring manual manipulation. The eccentric bushings 70, 72 are connected by arms 166, 168 to a common link 154 which assures simultaneous movement of the two blanket cylinders. The common link 154 is caused to rotate by a double air cylinder assembly 120, 122 connected to it through a linkage mechanism 136, 148, 150.

The double air cylinder comprises two pneumatic cylinders 120, 122 of different lengths connected to each other in tandem with the piston rods 134, 130 extending coaxially but in opposite directions. By separately extending or retracting each of the piston rods 130, 134, four different positions of the common link can be achieved, one corresponding to a blanket-to-blanket printing mode, one corresponding to a blanket-to-impression printing mode, and two corresponding to throw off positions, one for each of the two printing modes.

A press constructed according to the present invention also includes a cam and follower mechanism 200 (FIG. 7) which enables the form rollers 202, 204, 206 of the inkers 40 and dampers 44 in the lower deck printing units to follow the movement of the associated plate cylinder 50 when it is shifted without the necessity of readjusting them. The flat formed between the form rollers and a respective plate cylinder is adjusted by means of a cam ring 240 which is mounted for rotation about the axis of rotation 92 of the plate cylinder 50. The form rollers, e.g., 206, are mounted on brackets, e.g., 220, which are pivotably mounted to the press frame. The bracket 220 is biased into engagement with the cam ring 240, and the cam ring is rotatable to vary the form flat. Adjustment of the flat is achieved by the adjustable link assembly 242. The link assembly 242 also causes a preselected motion of the cam ring when the cylinder 50 is shifted and this compensates for the movement of the cylinder to preserve the desired form roller adjustment.

The following is claimed:

1. An offset printing press comprising a frame, a pair of rotatable plate cylinders supported in said frame, a pair of rotatable blanket cylinders supported in said frame, an impression cylinder rotatable about an axis fixed in said frame, said blanket cylinders having perfecting positions in which said blanket cylinders print on opposite sides of a web advanced therebetween and multi-impression positions in which said blanket cylinders print on a web advanced between each of said blanket cylinders and said impression cylinder, means for shifting said blanket cylinders between said perfecting and multi-impression positions, said plate cylinders having first positions in which said plate cylinders engage said blanket cylinders when said blanket cylinders are in said perfecting positions and second positions in which said plate cylinders engage said blanket cylinders when said blanket cylinders are in said multi-impression positions, and means for shifting said plate cylinders between said first and second positions, said means for shifting said blanket cylinders including eccentric means mounted in said frame and supporting said blanket cylinders for movement along arcuate paths, linkage means connected with said eccentric means for actuating said eccentric means, and remotely actuatable motor means having a first portion connected to said frame and a second portion connected with said linkage means for moving said linkage means to four predetermined and distinct positions, one of said positions of said linkage means corresponding to said perfecting positions of said pair of blanket cylinders, one of said positions of said linkage means corresponding to said multi-impression positions of said pair of blanket cylinders, and the remaining two positions of said linkage means corresponding to throw off positions for said pair of blanket cylinders, said motor means comprising first and second cylinder assemblies each including a cylinder and a piston slidable within a respective one of said cylinder assemblies, said cylinder assemblies being connected with each other in tandem.

2. An offset printing press comprising a frame, a pair of rotatable plate cylinders supported in said frame, a pair of rotatable blanket cylinders supported in said frame, an impression cylinder rotatable about an axis fixed in said frame, said blanket cylinders having perfecting positions in which said blanket cylinders print on opposite sides of a web advanced therebetween and multi-impression positions in which said blanket cylinders print on a web advanced between each of said blanket cylinders and said impression cylinder, means for shifting said blanket cylinders between said perfecting and multi-impression positions, said plate cylinders having first positions in which said plate cylinders engage said blanket cylinders when said blanket cylinders are in said perfecting positions and second positions in which said plate cylinders engage said blanket cylinders when said blanket cylinders are in said multi-impression positions, and means for shifting said plate cylinders between said first and second positions, said means for shifting said blanket cylinders including eccentric means mounted in said frame and supporting said blanket cylinders for movement along arcuate paths, linkage means connected with said eccentric means for actuating said eccentric means, and remotely actuatable motor means having a first portion connected to said frame and a second portion connected with said linkage means for moving said linkage means to four predetermined and distinct positions, one of said positions of said linkage means corresponding to said perfecting positions of said pair of blanket cylinders, one of said positions of said linkage means corresponding to said multi-impression positions of said pair of blanket cylinders, and the remaining two positions of said linkage means corresponding to throw off positions for said pair of blanket cylinders, said motor means comprising first and second cylinder assemblies comprising a cylinder and a piston axially slidable in a respective one of said cylinder assemblies upon the application of fluid pressure to said piston, one of said pistons comprising said second portion of said motor means and being connected with said linkage means, and the other of said pistons comprising said first portion of said motor means and being connected with said frame.

3. An apparatus as set forth in claim 2 wherein said cylinder assemblies are fixedly connected with each other.

4. An apparatus as set forth in claim 2 further including fluid pressure means for independently extending and retracting each of said pistons with respect to said cylinder assemblies.

5. An offset printing press comprising a frame, a pair of rotatable plate cylinders supported in said frame, a pair of rotatable blanket cylinders supported in said frame, an impression cylinder rotatable about an axis fixed in said frame, said blanket cylinders having perfecting positions in which said blanket cylinders print on opposite sides of a web advanced therebetween and multi-impression positions in which said blanket cylinders print on a web advanced between each of said blanket cylinders and said impression cylinder, means for shifting said blanket cylinders between said perfecting and multi-impression positions, said plate cylinders having first positions in which said plate cylinders engage said blanket cylinders when said blanket cylinders are in said perfecting positions and second positions in which said plate cylinders engage said blanket cylinders when said blanket cylinders are in said multi-impression positions, and means for shifting said plate cylinders between said first and second positions, said means for shifting said blanket cylinders including eccentric means mounted in said frame and supporting said blanket cylinders for movement along arcuate paths, linkage means connected with said eccentric means for actuating said eccentric means, and remotely actuatable motor means having a first portion connected to said frame and a second portion connected with said linkage means for moving said linkage means to four predetermined and distinct positions, the first of said positions of said linkage means corresponding to said perfecting positions of said pair of blanket cylinders, the second of said positions of said linkage means corresponding to said multi-impression positions of said pair of blanket cylinders, and the remaining third and fourth positions of said linkage means corresponding to respective throw off positions for said pair of blanket cylinders, said linkage means including first and second axially extending arms, one end of each of said arms being pivotally connected to one of said eccentric means, a rotatable common link, the other end of each of said arms being pivotally connected with said common link, means supporting said common link for rotation about a fixed axis in said frame and remote from said other ends of said arms, and stop means fixed relative to said frame for limiting the rotation of said common link in one direction to thereby determine one end of said arcuate paths of movement of said blanket cylinders.

6. An apparatus as set forth in claim 5 wherein one of said arms and said common link cooperate to form a toggle, said toggle moving over center when said linkage means moves between said second and fourth positions of said linkage means to move said blanket cylinders from said multi-impression positions to the corresponding one of said throw-off positions.

7. An apparatus as set forth in claim 5 wherein said linkage means further includes an axially extending connecting rod and a rotatable crank arm, said connecting rod being pivotably connected with said common link and said crank arm, said motor means being connected with said crank arm to cause rotation of said crank arm upon actuation of said motor means, and adjustable stop means fixed with respect to said frame for limiting rotation of said crank arm in one direction to thereby determine another end of said arcuate paths of movement of said cylinders.

8. An apparatus as set forth in claim 7 wherein said connecting rod and said crank arm cooperate to form a toggle, said toggle moving over center when said linkage means moves between said second and fourth positions of said linkage means to move said blanket cylinders from said multi-impression positions to the corresponding one of said throw-off positions.

9. An offset printing press comprising a frame, a pair of rotatable plate cylinders supported in said frame, a pair of rotatable blanket cylinders supported in said frame, an impression cylinder rotatable about an axis fixed in said frame, said blanket cylinders having perfecting positions in which said blanket cylinders print on opposite sides of a web advanced therebetween and multi-impression positions in which said blanket cylinders print on a web advanced between each of said blanket cylinders and said impression cylinder, means for shifting said blanket cylinders between said perfecting and multi-impression positions, said plate cylinders having first positions in which said plate cylinders engage said blanket cylinders when said blanket cylinders are in said perfecting positions and second positions in which said plate cylinders engage said blanket cylinders when said blanket cylinders are in said multi-impression positions, and means for shifting said plate cylinders between said first and second positions, said means for shifting said blanket cylinders including eccentric means mounted in said frame and supporting said blanket cylinders for movement along arcuate paths between said positions, linkage means connected with said eccentric means for actuating said eccentric means, and remotely actuatable motor means having a first portion connected to said frame and a second portion connected with said linkage means for moving said linkage means to four predetermined and distinct positions, one of said positions of said linkage means corresponding to said perfecting position of said pair of blanket cylinders, one of said positions of said linkage means corresponding to said multi-impression positions of said pair of blanket cylinders, and the remaining two positions of said linkage means corresponding to throw off positions for said pair of blanket cylinders.

10. An offset press as set forth in claim 9 wherein said arcuate paths are symmetric about a plane which includes the fixed axis of rotation of said impression cylinder.

11. An offset press as set forth in claim 10 further including a third blanket cylinder disposed in contact with said impression cylinder and rotatable about an axis lying in said plane of symmetry, and a third plate cylinder cooperating with said third blanket cylinder.

* * * * *